US008770777B2

(12) United States Patent
Yoshida et al.

(10) Patent No.: US 8,770,777 B2
(45) Date of Patent: Jul. 8, 2014

(54) SPARK PLUG

(75) Inventors: Haruki Yoshida, Tajimi (JP); Toshitaka Honda, Aichi (JP); Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/816,567

(22) PCT Filed: Sep. 16, 2011

(86) PCT No.: PCT/JP2011/005238

§ 371 (c)(1),
(2), (4) Date: Feb. 12, 2013

(87) PCT Pub. No.: WO2012/042774

PCT Pub. Date: Apr. 5, 2012

(65) Prior Publication Data

US 2013/0140975 A1 Jun. 6, 2013

(30) Foreign Application Priority Data

Oct. 1, 2010 (JP) ..... 2010-224266

(51) Int. Cl.
*H01T 13/02* (2006.01)
*H01T 13/05* (2006.01)

(52) U.S. Cl.
CPC ..... *H01T 13/05* (2013.01); *H01T 13/02* (2013.01)
USPC ..... 362/135; 362/141

(58) Field of Classification Search
None
See application file for complete search history.

(56) References Cited

U.S. PATENT DOCUMENTS 6,188,166 B1 * 2/2001 Nishikawa et al. ..... 313/141
8,299,694 B2 * 10/2012 Suzuki et al. ..... 313/141
2010/0264823 A1 10/2010 Suzuki et al. ..... 315/71

FOREIGN PATENT DOCUMENTS

JP 2006-286327 10/2006 ..... H01T 13/20
JP 2009-245716 10/2009 ..... H01T 13/20

OTHER PUBLICATIONS

International Search Report for International Application No. PCT/JP2011/005238, Dec. 27, 2011.

* cited by examiner

*Primary Examiner* — Britt D Hanley
(74) *Attorney, Agent, or Firm* — Kusner & Jaffe

(57) ABSTRACT

A spark plug having excellent load life performance even when the spark plug receives an impact or vibration. The spark plug includes an accommodated portion of a metallic terminal, which is accommodated in an axial hole of an insulator, having a plurality of bent portions formed as a result of proper bending of the accommodated portion. The bent portions are in close vicinity to an inner circumferential surface of the insulator at three or more locations, and are present without localizing in the radial direction of the axial hole.

9 Claims, 9 Drawing Sheets

SPARK PLUG

FIELD OF THE INVENTION

The present invention relates to a spark plug used for igniting an internal combustion engine. Specifically, the present invention relates to a spark plug having a resistor incorporated therein.

BACKGROUND OF THE INVENTION

In general, a spark plug used for igniting an internal combustion engine such an automotive engine includes a tubular metallic shell; a tubular insulator disposed in the bore of the metallic shell; a center electrode disposed in a forward end portion of the axial hole of the insulator; a metallic terminal disposed in a rear end portion of the axial hole; and a ground electrode whose one end is joined to the forward end of the metallic shell and whose other end faces the center electrode so as to form a spark discharge gap. Further, there has been known a spark plug including a resistor which is disposed in the axial hole between the center electrode and the metallic terminal so as to prevent generation of radio noise.

In general, such a resistor is formed from a mixture of glass powder and an electrically conductive substance such as carbon black powder or metal powder. However, since the amount of metal contained in the resistor is not so large, difficulty is encountered in joining the resistor directly to the metallic terminal and the center electrode, which are formed of metal. In order to eliminate the difficulty, in general, a seal layer containing a metal powder in a relatively large amount is disposed between the metallic terminal and the resistor and between the center electrode and the resistor to thereby increase the joint strength therebetween.

Incidentally, recent internal combustion engines for automobiles or the like have been required to produce a higher power and to operate with a higher efficiency, and development of a spark plug of a reduced size has been demanded in order to allow free design of engines and a reduction in the size of engines themselves. In order to reduce the size of a spark plug, the diameter of the insulator must be decreased. Meanwhile, in order to secure the desired characteristics such as mechanical strength of the insulator, the insulator must have a predetermined thickness in the radial direction. Accordingly, in order to reduce the diameter of the insulator, the diameter of the bore of the insulator must be decreased. However, when the diameter of the bore of the insulator is decreased, the diameters of the resistor and the seal layer also decrease. In such a case, the joint strength between the resistor and the seal layer decreases, and when an impact or vibration acts on the spark plug, a crack is generated at the interface between the resistor and the seal layer, which may result in deterioration of load life performance.

A spark plug which can solve such a problem is disclosed in, for example, Japanese Patent Application Laid-Open (kokai) No. 2009-245716 ("Patent Document 1"). In claim 1 of Patent Document 1, there is recited a "spark plug characterized in that the diameter D of the electrically conductive glass seal layer is 3.3 mm or less, and the joint surface between the electrically conductive glass seal layer and the resistor is formed to have a curved shape." Patent Document 1 states that, the invention can provide a "spark plug which is enhanced in adhesion between the resistor and the electrically conductive glass seal layer, which is excellent in vibration resistance and load life performance of the resistor, and which has a reduced diameter" (see paragraph 0012).

SUMMARY OF THE INVENTION

Problems to be Solved by the Invention

An object of the present invention is to provide a spark plug which is excellent in load life performance even when it receives an impact or vibration.

Means for Solving the Problems

Means for solving the above-described problems is as follows.

(1) A spark plug comprising:

an insulator having an axial hole extending in a direction of an axis;

a center electrode held at one end of the axial hole;

a metallic terminal which has an accommodated portion accommodated in the axial hole and which is held at the other end of the insulator; and a connecting portion which electrically connects the center electrode and the metallic terminal within the axial hole, the spark plug being characterized in that the side of the axial hole where the metallic terminal is held is defined as a rear end side with respect to the direction of the axis;

a connection member which constitutes the connecting portion is provided between an outer circumferential surface of a forward end portion of the accommodated portion and an inner circumferential surface of the insulator; and in sectional images orthogonal to the axis which are captured at intervals of 0.5 mm from a rear end of the accommodated portion toward a forward end thereof up to a rear end position where the connection member is present, on a sectional image $S_n$ at the n-th section (n is a natural number) counted from the rear end of the accommodated portion, a center of the accommodated portion is defined as a point $a_n$, a center of the axial hole is defined as a point $O_n$, a line which passes through the points $a_n$ and $O_n$ is defined as a line $L_n$, a diameter of the axial hole is represented by $2R_n$, a diameter of the accommodated portion is represented by $2r_n$, a distance between the point $a_n$ and the point $O_n$ is represented by $H_{aon}$, and the point $a_n$ which satisfies a relation $H_{aon} \geq 0.8(R_n - r_n)$ is defined as a point $A_n$, on the sectional image $S_1$, a line which is obtained by rotating a line $L_1$ by 45° about the point $O_1$ is defined as a line $L_{1+}$, a line which is obtained by rotating the line $L_1$ by −45° about the point $O_1$ is defined as a line $L_{1-}$, four areas which are surrounded by a plane $X_+$ containing the line $L_{1+}$ and the axis, a plane $X_-$ containing the line $L_{1-}$ and the axis, and the inner circumferential surface of the insulator are identified by $T_1$, $T_2$, $T_3$, and $T_4$, respectively, and when successive points $A_m$ to $A_{(m+k)}$ (m and k are natural numbers) are present in a specific area selected from the areas $T_1$, $T_2$, $T_3$, and $T_4$, a group containing these points $A_m$ to $A_{(m+k)}$ is defined as a group $B_{m,y}$, where y is a natural number and means that the group is the y-th group counted from the rear end side of the accommodated portion, wherein the maximum value of y is at least 3, and at least two of the groups $B_{m,y}$ are present in two areas which are selected from the areas $T_1$ to $T_4$ and which are located at symmetrical positions.

Preferred modes of the means (1) are as follows:

(2) an inter-bend distance D, which is a distance along the direction of the axis between a sectional image containing a point $A_s$ (the first point $A_n$ counted from the rear end of the accommodated portion) and a sectional image containing a point $A_e$ (the last point $A_n$ counted from the rear end of the accommodated portion) is 5 mm or greater;

(3) the groups $B_{m,y}$ are present in at least three areas selected from the areas $T_1$ to $T_4$;

the maximum value of y is at least 4;

(5) the groups $B_{m,y}$ are present in all the areas $T_1$ to $T_4$;

(6) the maximum value of y is at least 5;

(7) an intermediate-diameter portion diameter, which is a diameter of the axial hole (2) at a position where the forward end portion (20) is disposed, is 2.9 mm or less;

(8) the inter-bend distance D is 7 mm or greater; and (9) the inter-bend distance D is 10 mm or greater.

Effects of the Invention

In the spark plug of the present invention, the maximum value of y is at least 3, and at least two of the groups $B_{m,y}$ are present in two areas which are selected from the areas $T_1$ to $T_4$ and which are located at positions symmetrical to each other. Therefore, there can be provided a spark plug which is excellent in load life performance even when it receives an impact or vibration. In other words, a plurality of bent portions formed as a result of proper bending of the accommodated portion are in close vicinity to the inner circumferential surface of the insulator at three or more locations, and are present without localizing in the radial direction of the axial hole. Therefore, when the spark plug receives an impact or vibration, the plurality of bent portions in close vicinity to the inner circumferential surface of the insulator serve as fulcrums to thereby suppress vibration of the accommodated portion. Therefore, the vibration of the accommodated portion is not transmitted to the connecting portion, and it is possible to prevent generation of a crack at the boundaries between the resistor and the first and second seal layers, which constitute the connecting portion. As a result, the resistance of the connecting portion does not increase sharply. Therefore, there can be provided a spark plug which is excellent in load life performance even when it receives an impact or vibration.

In the spark plug of the present invention, the distance in the axis direction between a sectional image containing the point $A_s$ and a sectional image containing the point $A_e$ is at least 5 mm. Therefore, of the above-described plurality of bent portions, two bent portions located at opposite ends thereof separate from each other by a predetermined distance in the axial direction. Thus, vibration of the accommodated portion can be suppressed to a greater degree. As a result, the spark plug has improved load life performance after it receives an impact or vibration.

In the spark plug of the present invention, when the intermediate-diameter portion diameter is 2.9 mm or less, the effect of improving load life performance is enhanced.

DETAILED DESCRIPTION OF THE INVENTION

Figure 1:
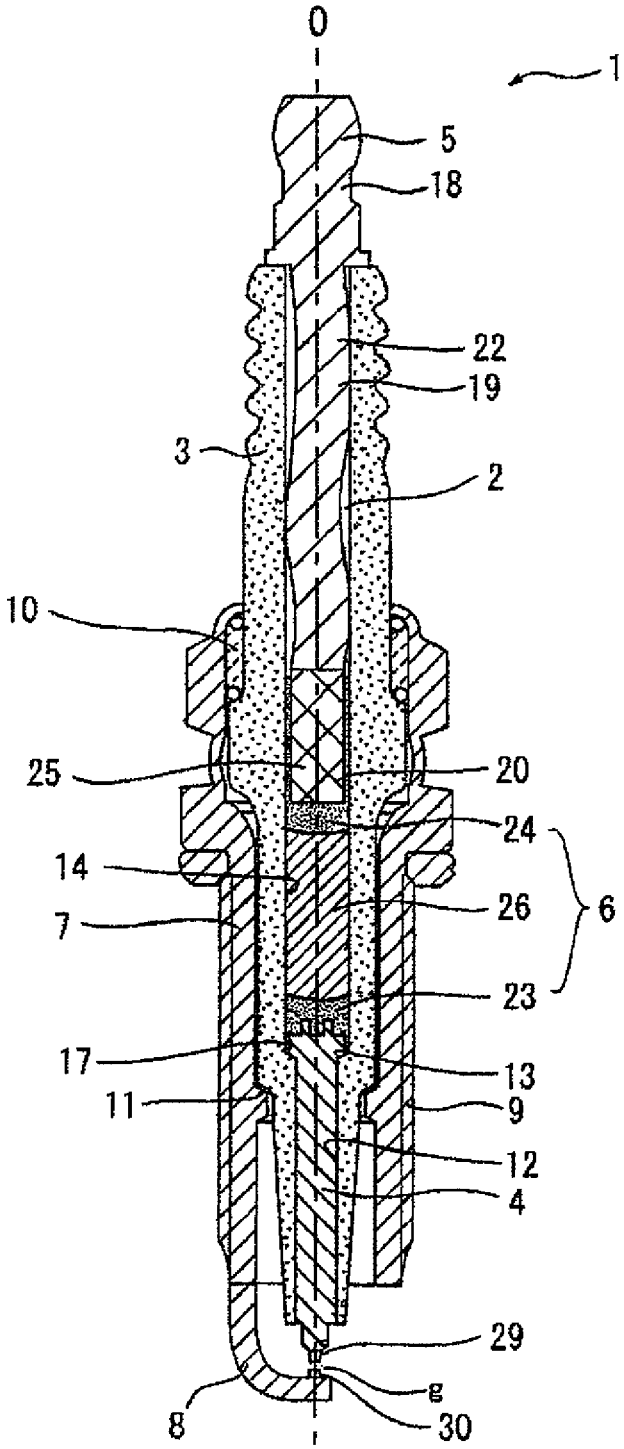
FIG. 1 is an explanatory view showing a cross section of the entirety of a spark plug which is one embodiment of a spark plug according to the present invention.

FIG. 1 shows a spark plug which is one embodiment of a spark plug according to the present invention. FIG. 1 is an explanatory sectional view showing the entirety of a spark plug 1 which is one embodiment of the spark plug according to the present invention. In FIG. 1, the axis of an insulator is denoted by O. In the following description, the lower side of the sheet on which FIG. 1 is drawn; i.e., the side where a center electrode is held, will be referred to as the forward end side along the axis O, and the upper side of the sheet on which FIG. 1 is drawn; i.e., the side where a metallic terminal is held, will be referred to as the rear end side along the axis O.

This spark plug 1 includes an insulator 3 which has an axial hole 2 extending in the direction of the axis O; a center electrode 4 which is held at the forward end of the axial hole 2; a metallic terminal 5 which is held at the rear end of the axial hole 2; a connecting portion 6 which electrically connects the center electrode 4 and the metallic terminal 5 within the axial hole 2; a metallic shell 7 which accommodates the insulator 3; and a ground electrode 8 whose one end is joined to a forward end surface of the metallic shell 7 and whose other end faces the center electrode 4 with gap formed therebetween.

The metallic shell 7 has a generally cylindrical shape and is formed to accommodate and hold the insulator 3. A threaded portion 9 is formed on the outer circumferential surface of a forward end portion of the metallic shell 7. The spark plug 1 is attached to the cylinder head of an unillustrated internal combustion engine through use of the threaded portion 9. The metallic shell 7 may be formed of an electrically conductive steel material such as low-carbon steel. Preferably, the threaded portion 9 has a size of M12 or less in order to decrease the diameter thereof.

The insulator 3 is held inside the metallic shell 7 via talc 10, a packing 11, etc. The axial hole 2 of the insulator 3 has a small-diameter portion 12 and an intermediate-diameter portion 14. The small-diameter portion 12 holds the center electrode 4 on the forward end side along the axis O. The intermediate-diameter portion 14 accommodates the connecting portion 6 and an accommodated portion 19 of the metallic terminal 5 which has a generally cylindrical columnar shape and which extends forward. The intermediate-diameter portion 14 is greater in diameter than the small-diameter portion 12, and is located adjacent to the small-diameter portion 12 via a step portion 13. The insulator 3 is fixed to the metallic shell 7 such that a forward end portion of the insulator 3 projects from the forward end surface of the metallic shell 7. The insulator 3 is desirably formed of a material which is sufficiently high in mechanical strength, thermal strength, electrical strength, etc. An example of such a material is a ceramic sintered body containing alumina as a main component.

The center electrode 4 is accommodated in the small-diameter portion 12 of the axial hole 2, and flange portion 17 provided at the rear end of the center electrode 4 and having a larger diameter is engaged with the step portion 13 of the axial hole 2. Thus, the center electrode 4 is held such that the forward end of the center electrode 4 projects from the forward end surface of the insulator 3, and the center electrode 4 is insulated from the metallic shell 7. The center electrode 4 is desirably formed of a material having a sufficient thermal conductivity, a sufficient mechanical strength, etc. For example, the center electrode 4 is formed of a nickel alloy such as Inconel (trademark). A core portion of the center electrode 4 may be formed of a metallic material which is excellent in thermal conductivity such as Cu or Ag.

The ground electrode 8 is formed into, for example, a generally prismatic shape. The ground electrode 8 is joined at its one end to the forward end surface of the metallic shell 7, and is bent in the middle to have a generally L-like shape. The shape and structure of the ground electrode 8 are designed such that its distal end portion faces a forward end portion of the center electrode 4 with a gap formed therebetween. The ground electrode 8 is formed of the same material as that of the center electrode 4.

Noble metal tips 29 and 30 formed of a platinum alloy, an iridium alloy, or the like may be respectively provided on the surfaces of the center electrode 4 and the ground electrode 8 which face each other. Alternatively, a noble metal tip may be provided on only one of the center electrode 4 and the ground electrode 8. In the spark plug 1 of the present embodiment, both the center electrode 4 and the ground electrode 8 have the noble metal tips 29 and 30 provided thereon, and a spark discharge gap g is formed between the noble metal tips 29 and 30.

The metallic terminal 5 is used to externally apply to the center electrode 4 a voltage for generating spark discharge between the center electrode 4 and the ground electrode 8. The metallic terminal 5 has an exposed portion 18 and the accommodated portion 19 having a generally circular columnar shape. The exposed portion 18 has an outer diameter greater than the diameter of the axial hole 2 and is exposed from the axial hole 2. A flange-shaped portion of the exposed portion 18 butts against the end surface of the insulator 3 located on the rear end side with respect to the direction of the axis O. The accommodated portion 19 extends forward from the end surface of the exposed portion 18 located on the forward end side with respect to the direction of the axis O, and is accommodated in the axial hole 2. The accommodated portion 19 has a fixing portion 25 and a trunk portion 22. The fixing portion 25 is located at a forward end 20 along the axis O, and has an uneven surface. The trunk portion 22 is located rearward of the fixing portion 25 along the axis O, and is located adjacent to the exposed portion 18. The fixing portion 25 and the trunk portion 22 are accommodated in the intermediate-diameter portion 14. In the spark plug of the present embodiment, the outer circumferential surface of the fixing portion 25 is knurled. Since the outer circumferential surface of the fixing portion 25 has an uneven structure formed by, for example, knurling, the degree of adhesion between the metallic terminal 5 and the connecting portion 6 increases. As a result, the metallic terminal 5 and the insulator 3 are firmly fixed together. The metallic terminal 5 is formed of, for example, low-carbon steel or the like, and a nickel layer is formed on the surface of the metallic terminal 5 through plating or the like.

The connecting portion 6 is disposed in the axial hole 2 such that it is located between the center electrode 4 and the metallic terminal 5, and electrically connects the center electrode 4 and the metallic terminal 5. The connecting portion 6 includes a resistor 26 and prevents generation of radio noise by the action of the resistor 26. The connecting portion 6 has a first seal layer 23 between the resistor 26 and the center electrode 4 and a second seal layer 24 between the resistor 26 and the metallic terminal 5. The first seal layer 23 and the second seal layer 24 fix the insulator 3, and the center electrode 4 and the metallic terminal 5 in a sealed condition.

The resistor 26 may be constituted by a resistor member formed by sintering a resistor composition which contains powder of glass such as borosillicate soda glass, powder of ceramic such as $ZrO_2$, electrically conductive nonmetallic powder such as carbon black, and/or powder of metal such as Zn, Sb, Sn, Ag, Ni, etc. The resistor 26 typically has a resistance of 100Ω or higher.

The first seal layer 23 and the second seal layer 24 may be constituted by a seal material which is formed by sintering a seal powder which contains powder of glass such as borosillicate soda glass and powder of metal such as Cu, Fe, etc. Each of the first seal layer 23 and the second seal layer 24 typically has a resistance of 100 mΩ or lower.

Since the first seal layer 23 and the second seal layer 24 contain the metallic component in an amount greater than in the resistor 26, these seal layers are disposed between the resister 26, and the center electrode 4 and the metallic terminal 5 so as to increase the joint strength therebetween. In the following description, the resistor member and the seal member constituting the connecting portion 6 may be collectively referred to as a connecting member, and the resistor composition and the seal powder used for forming the connecting portion 6 may be collectively referred to as connecting portion forming powder.

Figure 2:
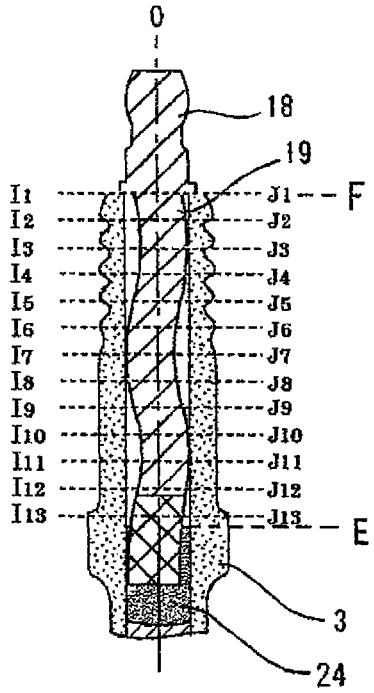
FIG. 2 is an explanatory view showing a cross section of a main portion of the spark plug which is one embodiment of the spark plug according to the present invention.

FIG. 2 is an explanatory sectional view for describing the characteristic portion of the spark plug of the present invention. Accordingly, FIG. 2 mainly shows the insulator and the metallic terminal of the spark plug, and the members disposed forward of the metallic terminal, the metallic shell, etc. are omitted.

As shown in FIG. 2, in the spark plug of the present invention, the accommodated portion 19 is bent in a wavy shape, and has a plurality of bent portions which are located in close vicinity to the inner circumferential surface of the axial hole 2 of the insulator 3. In the case where sectional images $S_n$ orthogonal to the axis are captured, through use of a micro X-ray CT apparatus (e.g., TOSCANER-32250μhd), at intervals of 0.5 mm from the rear end F of the accommodated portion 19 (i.e., the boundary between the exposed portion 18 and the accommodated portion 19) toward the front end thereof up to a rear end position E at which the connection member is present, the sectional image $S_n$ of the spark plug of the present invention has the following feature.

Line $I_1$-$J_1$ in FIG. 2 shows the position (in the direction of the axis O) of a sectional image $S_1$ which is first captured from the rear end side of the accommodated portion 19. In the present embodiment, 13 sectional images $S_n$ in total are captured until a sectional image $S_{13}$ is captured at a position within a 0.5 mm range extending rearward from the rear end position E of the connection member. Notably, $S_n$ represents that a sectional image denoted by $S_n$ is the n-th sectional image counted from the rear end of the accommodated portion 19.

Accordingly, in the spark plug of the present embodiment, n is a natural number between 1 and 13. Since the sectional image is captured at intervals of 0.5 mm along the axial direction, the distance EF between the rear end F of the accommodated portion 19 (i.e., line $I_1$-$J_1$) and the position E at which the connection member is present falls within a range of 6 mm (the distance between line and $I_1$-$J_1$ and $I_{13}$-$J_{13}$) to 6.5 mm.

In the spark plug of the present invention, preferably, the distance EF between the rear end F of the accommodated portion 19 and the position E at which the connection member is present is 15 mm to 70 mm. In this case, the number of sectional images $S_n$ to be obtained is 15/0.5 (decimals omitted)+1=31 to 70/0.5 (decimals omitted)+1=141. Notably, in order to facilitate description, FIG. 2 shows a spark plug of an embodiment in which the distance EF is smaller than 15 mm.

Figure 3:
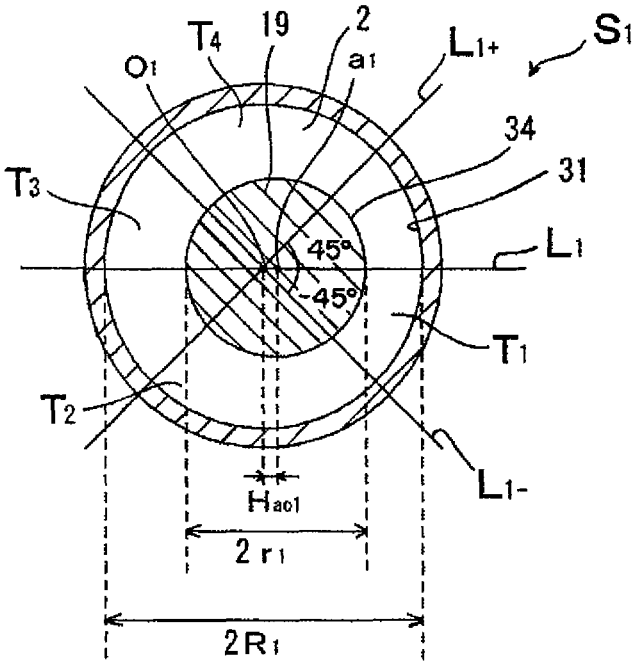
FIG. 3 is an explanatory view showing a sectional image $S_1$ of the spark plug shown in FIG. 2 taken along line $I_1$-$J_1$.

FIG. 3 is an explanatory view of the sectional image $S_1$ of the spark plug shown in FIG. 2 taken along line $I_1$-$J_1$.

In FIG. 3, a point $a_1$ represents the center of the accommodated portion 19 on the sectional image $S_1$; a point $O_1$ represents the center of the axial hole 2; a line $L_1$ represents a line which passes through the points $a_1$ and $O_1$; $2R_1$ represents the diameter of the axial hole 2; $2r_1$ represents the diameter of the accommodated portion 19, and $H_{ao1}$ represents the distance between the point $a_1$ and the point $O_1$. When a relation $H_{ao1} \geq 0.8(R_1-r_1)$ is satisfied, the point $a_1$ is defined as a point $A_1$.

The point $a_1$ satisfies the above-mentioned relational expression when the point $a_1$ deviates from the point $O_1$ by a distance which is at least 80% of the distance $(R_1-r_1)$ between the inner circumferential surface 31 of the insulator 3 and the outer circumferential surface 34 of the accommodated portion 19 measured in a state in which the point $a_1$ coincides with the point $O_1$. In the case where the point $a_1$ deviates from the point $O_1$ by an amount corresponding to the distance $(R_1-r_1)$, the outer circumferential surface 34 of the accommodated portion 19 comes into contact with the inner circumferential surface 31 of the insulator 3. In the case where the accommodated portion 19 is bent such that the accommodated portion 19 approaches the inner circumferential surface 31 of the insulator 3 and the point $a_1$ is located at a position where the point $a_1$ satisfies the above-described relational expression, the point $a_1$ is defined as a point $A_1$.

In the sectional image $S_1$ in the present embodiment, as shown in FIG. 3, the point $a_1$ deviates from the point $O_1$ only slightly, and does not satisfy the above-described relational expression.

In the case of n=2 to 13 as well, like the case of n=1, a point $a_n$, a point $O_n$, a line $L_n$, $2R_n$, $2r_n$, $H_{aon}$ are defined. When the point $a_n$ satisfies the following relational expression on the sectional image $S_n$, the point $a_n$ is defined as a point $A_n$.

$$H_{aon} \geq 0.8(R_n-r_n) \quad (1)$$

Figure 4A:
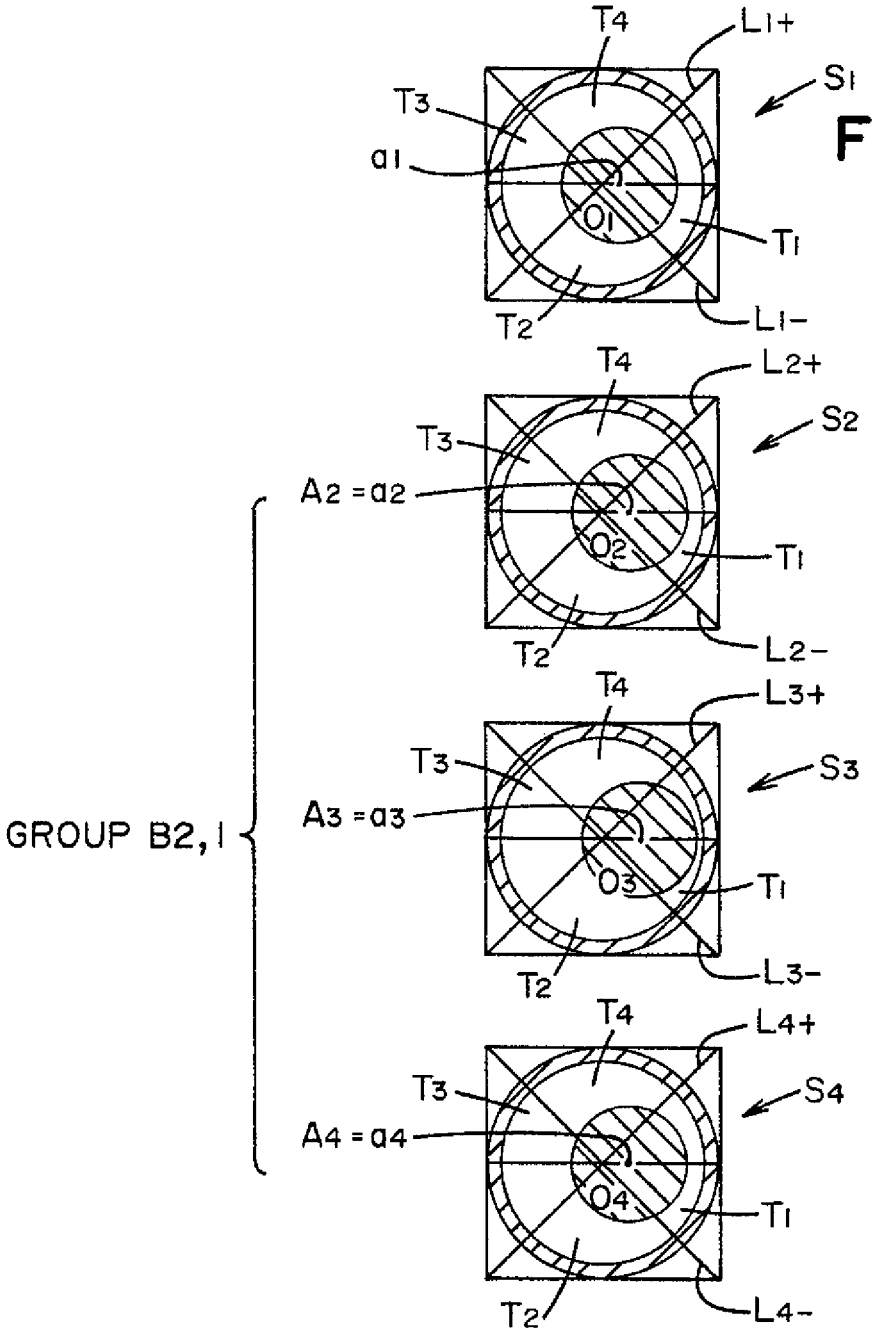
FIGS. 4A-4C are explanatory views showing sectional images in which sectional images $S_n$ of the spark plug shown in FIG. 2 taken along lines $I_n$-$J_n$ are arranged from the rear end side.
Figure 4B:
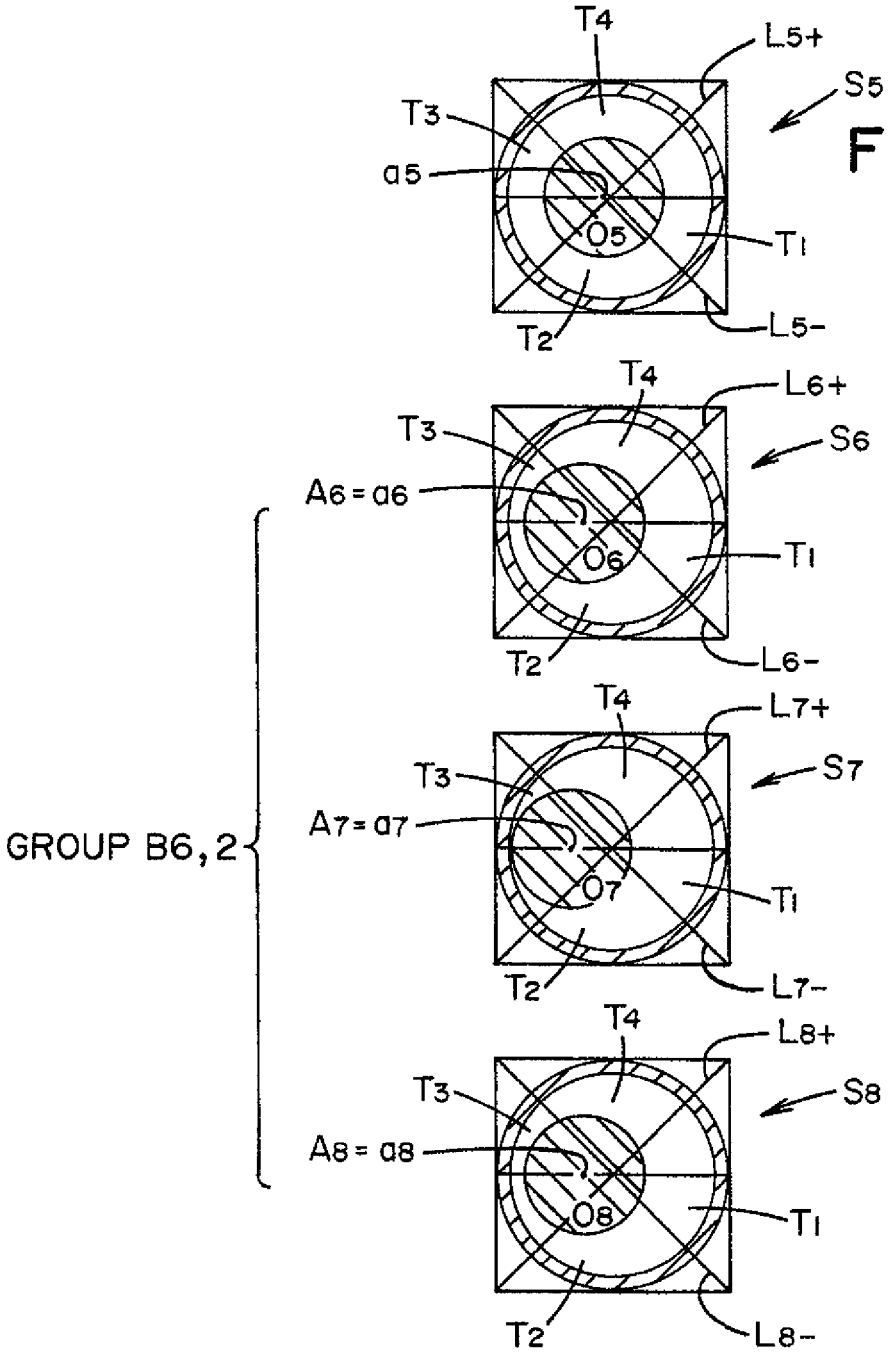
Figure 4C:
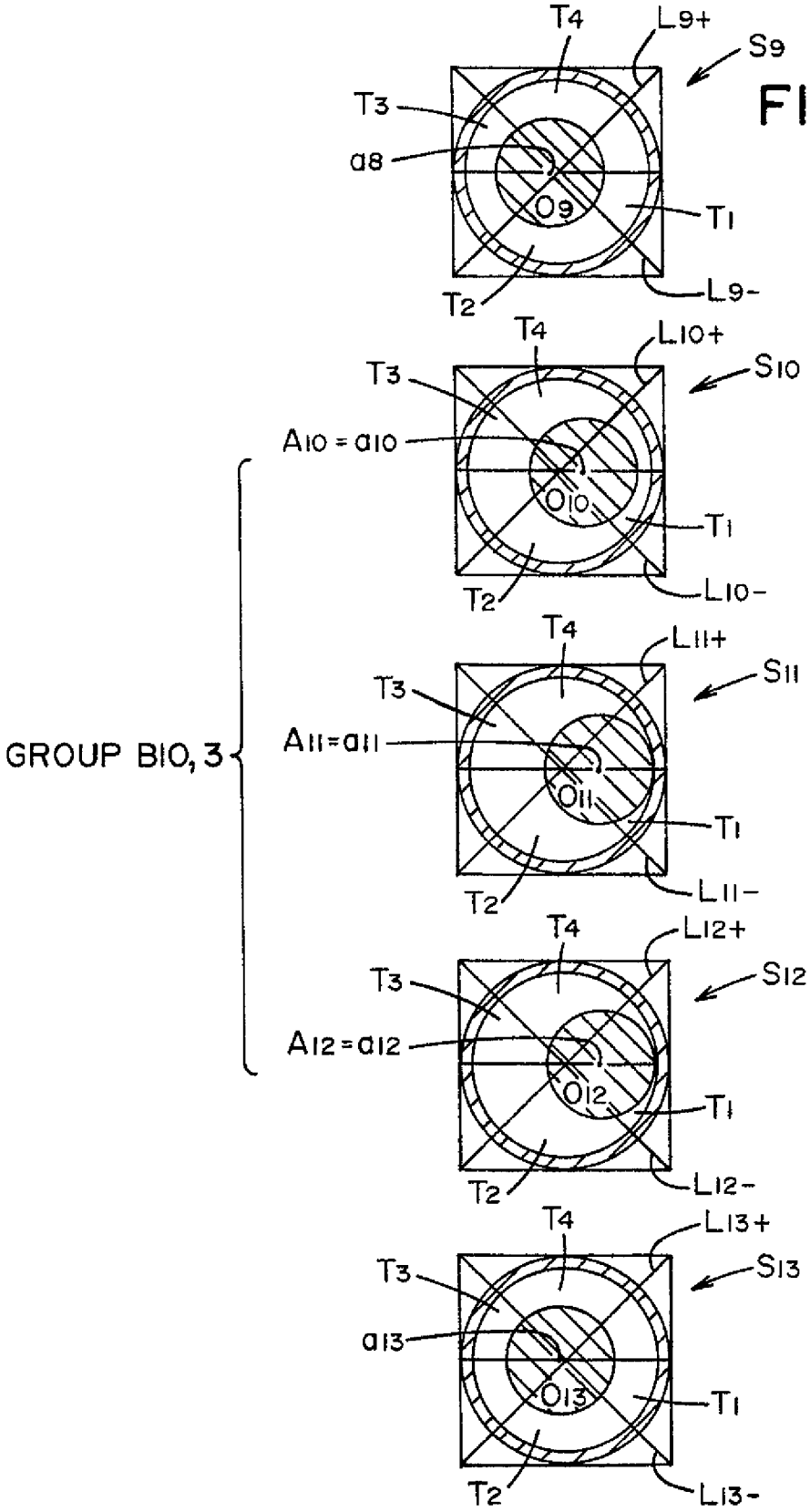

FIGS. 4A-4C are explanatory views showing sectional images in which the sectional images $S_n$ of the spark plug shown in FIG. 2 taken along lines $I_n$-$J_n$ are arranged from the rear end side. As shown in FIGS. 4A-4C, in the spark plug of the present embodiment, since the point $a_n$ on each of the sectional images $S_2$ to $S_4$, $S_6$ to $S_8$, and $S_{10}$ to $S_{12}$ satisfies the above-mentioned relational expression (1), the center points $a_2$ to $a_4$, $a_6$ to $a_8$, and $a_{10}$ to $a_{12}$ of the accommodated portion 19 are referred to as points $A_2$ to $A_4$, $A_6$ to $A_8$, and $A_{10}$ to $A_{12}$.

Figure 5:
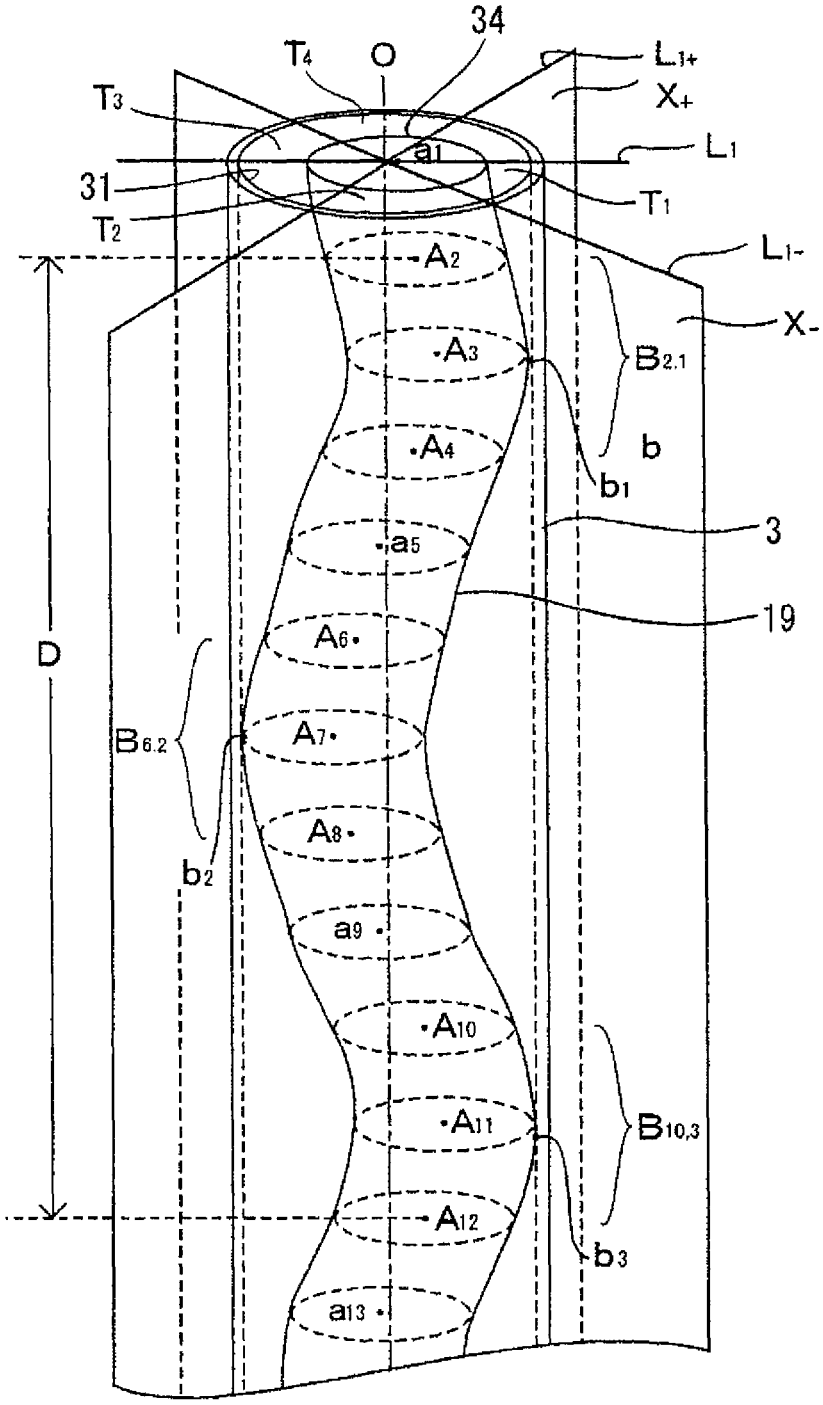
FIG. 5 is an explanatory perspective view of main portion between lines $I_1$-$J_1$ and $I_{13}$-$J_{13}$ of FIG. 2.

Next, FIG. 5 shows an explanatory perspective view of a main portion between lines $I_1$-$J_1$ and $I_{13}$-$J_{13}$ in FIG. 2. As shown in FIG. 3, a line which is obtained by rotating the line $L_1$ on the sectional image $S_1$ by 45° about the point $O_1$ is defined as a line $L_{1+}$, and a line which is obtained by rotating the line $L_1$ by −45° about the point $O_1$ is defined as a line $L_{1-}$. As shown in FIG. 5, four areas which are surrounded by a plane $X_+$ containing the line $L_{1+}$ and the axis O, a plane $X_-$ containing the line $L_{1-}$ and the axis O, and the inner circumferential surface 31 of the insulator 3 are identified by $T_1$, $T_2$, $T_3$, and $T_4$, respectively. In the present embodiment, the four areas are identified by $T_1$, $T_2$, $T_3$, and $T_4$, in this sequence in the clockwise direction, with the area in which the point $a_1$ is present being denoted by $T_1$.

In the case where successive points $A_m$ to $A_{(m+k)}$ (m and k are natural numbers) are present in a specific area selected from the above-mentioned areas $T_1$ to $T_4$, a group containing these points $A_m$ to $A_{(m+k)}$ is defined as a group $B_{m,y}$ (notably, y is a natural number and means that the group is the y-th group counted from the rear end side of the accommodated portion). In other words, when a point $a_m$ on the sectional image $S_m$ is located at a position where it satisfies the above-described relational expression (1), the point $a_m$ is defined as a point $A_m$; and when a point $a_{(m+1)}$ on the sectional image $S_{(m+1)}$ adjacently located forward of the sectional image $S_m$ is located at a position where it satisfies the above-described relational expression (1), the point $a_{(m+1)}$ is defined as a point $A_{(m+1)}$. When the points $a_m$ to $a_{(m+k)}$ on two or more sectional images (the sectional image $S_m$ to the sectional image $S_{(m+k)}$) successively satisfy the above-described relational expression (1), the points $a_m$ to $a_{(m+k)}$ are referred to as points $A_m$ to $A_{(m+k)}$. When these points $A_m$ to $A_{(m+k)}$ are present in a specific area selected from the above-mentioned areas $T_1$ to $T_4$, a group containing these points $A_m$ to $A_{(m+k)}$ is defined as a group $B_{m,y}$.

As shown in FIGS. 4A-4C, since the points $A_2$, $A_3$, and $A_4$ on the successively captured sectional images $S_2$, $S_3$, and $S_4$ satisfy the above-mentioned relational expression (1) and are present in a single area $T_1$, group including these points is defined as a group $B_{2,1}$. Similarly, since the points $A_6$, $A_7$, and $A_8$ on the successively captured sectional images $S_6$, $S_7$, and $S_8$ satisfy the above-mentioned relational expression (1) and are present in a single area $T_3$, a group including these points is defined as a group $B_{6,2}$. Similarly, since the points $A_{10}$, $A_{11}$, and $A_{12}$ on the successively captured sectional images $S_{10}$, $S_{11}$, and $S_{12}$ satisfy the above-mentioned relational expression (1) and are present in a single area $T_1$, a group including these points is defined as a group $B_{10,3}$.

In the spark plug of the present embodiment, since the number of the groups $B_{m,y}$ is 3, the maximum value of y is 3; and the groups $B_{2,1}$ and $B_{10,3}$ and the group $B_{6,2}$ are present in the two areas $T_1$ and $T_3$, which are located at symmetrical positions with respect to the axis O.

In the structure of a conventional spark plug has the following drawback. When the spark plug receives an impact or vibration, only the rear end of the accommodated portion is fixed, and the accommodated portion vibrates vigorously within the axial hole in a state in which the fixed rear end serves as a fulcrum. In contrast, in the spark plug of the present embodiment, the maximum value of y in its sectional images $S_n$ is 3, and two of the groups $B_{m,y}$ are present in two area located at symmetrical positions in relation to the axis O. Therefore, when the spark plug 1 receives an impact or vibration, as shown in FIG. 5, the accommodated portion 19 has fulcrums at points $b_1$, $b_2$, and $b_3$ which belong to the groups $B_{2,1}$, $B_{6,2}$, and $B_{10,3}$, respectively, and which are in close vicinity to the inner circumferential surface of the insulator 3, whereby the accommodated portion 19 is prevented from vigorously vibrating within the axial hole 2. As a result, it is possible to prevent generation of a crack between the first seal layer 23, and the second seal layer 24 and the resistor 26, especially between the second seal layer 24 and the resistor 26, which crack would otherwise be generated as a result of vigorous vibration of the accommodated portion 19 within the axial hole 2. Thus, it is possible to prevent occurrence of a contact failure and prevent the resistance of the connecting portion 6 from increasing sharply. Therefore, there can be provided a spark plug which is excellent in load life performance even when it receives an impact or vibration.

Notably, even in the case where the points $A_m$ to $A_{(m+k)}$ on the sectional image $S_m$ to $S_{(m+k)}$ which are contained in the groups $B_{m,y}$ are not present at positions where they satisfy the relational expression $H_{aon}=(R_n-r_n)$; i.e., in the case where the points $A_m$ to $A_{(m+k)}$ are not located at positions where the outer circumferential surface 34 of the accommodated portion 19 does not contact with the inner circumferential surface 31 of the insulator 3, there may be a case where a portion (e.g., the point $b_3$) other than the portion photographed as a sectional image $S_n$ becomes the closest to the inner circumferential surface 31. Accordingly, in the case where the points $A_m$ to $A_{(m+k)}$ contained in the groups $B_{m,y}$ deviate from the center points $O_n$ of the axial hole 2 by at least 80% of the distance $(R_1-r_1)$, when the spark plug receives an impact or vibration, the circumferential surface 34 of the accommodated portion 19 can have portions (fulcrums) which come into contact with the inner circumferential surface 31 of the insulator 3. Thus, vigorous vibration of the accommodated portion 19 within the axial hole 2 can be prevented.

In the sectional images $S_n$ of the spark plug of the present invention, the maximum value of y is at least 3, preferably at least 4, and most preferably at least 5. Although the maximum value changes depending on the length of the terminal, in general, the effect does not change when the maximum value becomes 20 or greater. Therefore, in general, the maximum value of y may be smaller than 20. The greater the value of y, the larger the number of bent portions which are formed on the accommodated portion and which are in close vicinity to the inner circumferential surface of the insulator; i.e., the larger the number of points at which the outer circumferential surface of the accommodated portion and the inner circumferential surface of the insulator come into contact with each other when the spark plug receives an impact. The greater the number of such points, the greater the degree to which vigorous vibration of the accommodated portion within the axial hole can be suppressed. Therefore, it is preferred to increase the number of such points to a possible degree.

In the sectional images $S_n$ of the spark plug of the present invention, preferably, at least two of the groups $B_{m,y}$ are present in two symmetrically located areas selected from the areas $T_1$ to $T_4$. Preferably, the groups $B_{m,y}$ are present in three areas. More preferably, the groups $B_{m,y}$ are present in all the areas. In the case where the bent portions of the accommodated portion located in close vicinity to the inner circumferential surface of the insulator (i.e., the points at which the outer circumferential surface of the accommodated portion and the inner circumferential surface of the insulator come into contact with each other when the spark plug receives an impact) are present at least at positions which are symmetrical with respect to the axis O, and preferably, are present evenly in the radial direction, vigorous vibration of the accommodated portion within the axial hole can be suppressed to a greater degree.

In the spark plug of the present invention, an inter-bend distance D, which is the distance (along the direction of the axis O) between a sectional image containing a point $A_s$ (notably, the point $A_s$ represents the first point $A_n$ counted from the rear end of the accommodated portion 19) and a sectional image containing a point $A_e$ (notably, the point $A_e$ represents the last point $A_n$ counted from the rear end of the accommodated portion 19), is preferably 5 mm or greater, more preferably 7 mm or greater, particularly preferably 10 mm or greater. Further, it is preferred that the distance D is equal to the length between the rear end of the accommodated portion and the rear end E of the connection member. When the inter-bend distance D is equal to or greater than a predetermined value, of the bent portions of the accommodated portion which are in close vicinity to the inner circumferential surface of the insulator, two bent portions located at opposite ends thereof separate from each other by a predetermined distance. Therefore, vigorous vibration of the accommodated portion within the axial hole can be suppressed to a greater degree.

In the spark plug of the present embodiment, the point $A_s$ is the point $A_2$, and the point $A_e$ is the point $A_{12}$. Since the sectional images are captured at intervals of 0.5 mm, the inter-bend distance D (along the direction of the axis O) between the sectional image $S_2$ and the sectional image $S_{12}$ is 5 mm.

In the spark plug of the present invention, when the diameter of the intermediate-diameter portion is 2.9 mm or less, load life performance in the case where the spark plug receives an impact or vibration can be improved further. The diameter of the intermediate-diameter portion is determined by measuring the diameter of the axial hole 2 at a position where the forward end portion of the metallic terminal 5 with respect to the direction of the axis O is disposed.

In general, the diameter $(2r_n)$ of the accommodated portion 19 of the spark plug of the present invention falls within a range of 70% to 97% of the diameter $(2R_n)$ of the axial hole 2 of the insulator 3.

Figure 6:
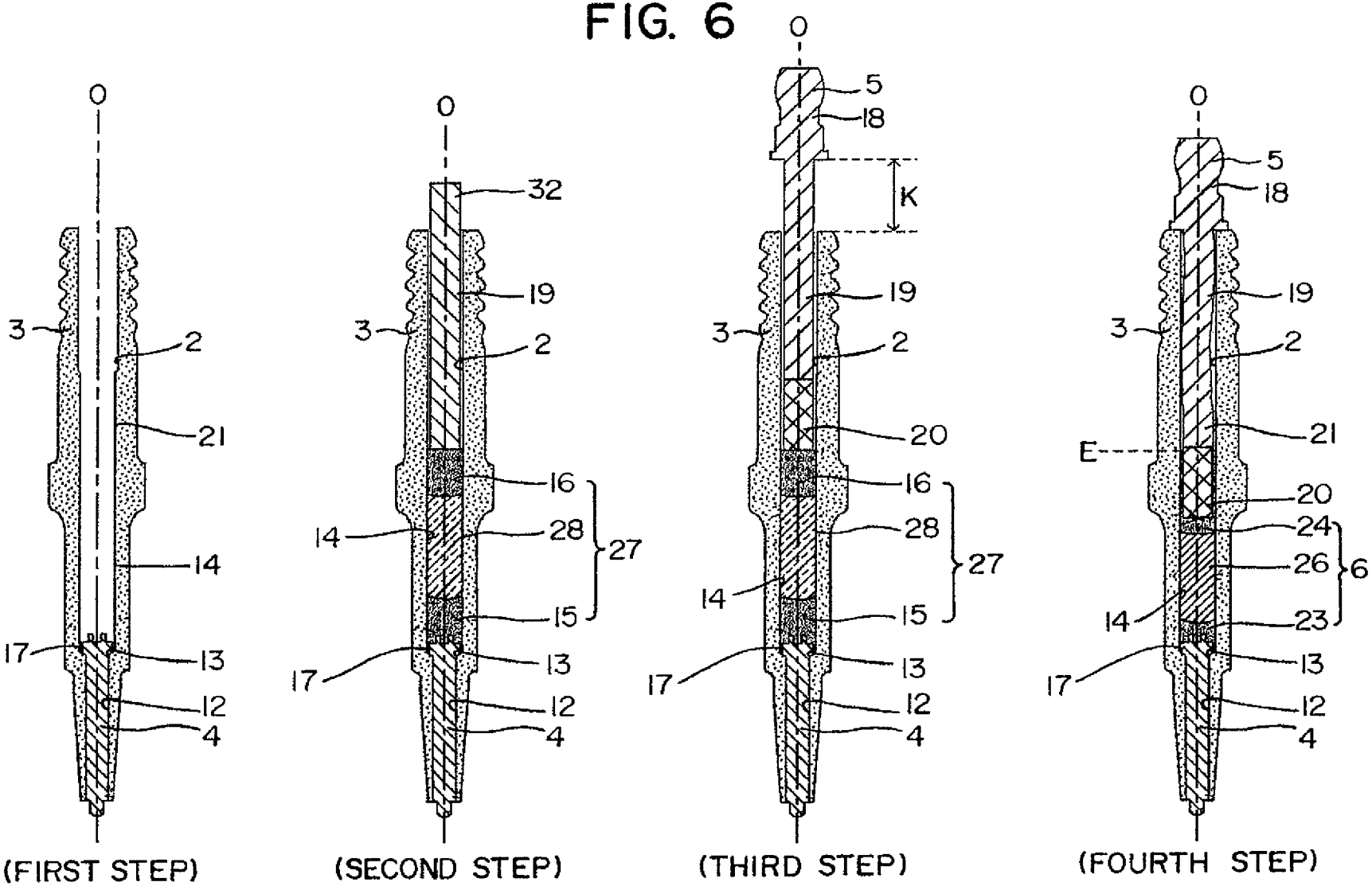
FIG. 6 is a set of process charts showing example steps of a spark plug manufacturing method according to the present invention.

For example, the spark plug 1 is manufactured as follows. Of the steps for manufacturing the spark plug 1, the steps of disposing and fixing the insulator, the center electrode, and the metallic terminal will be mainly described (see FIG. 6).

First, the center electrode 4, the ground electrode 8, the metallic shell 7, the metallic terminal 5, and the insulator 3 are fabricated by known methods such that they have predetermined shapes (preparing step), and one end portion of the ground electrode 8 is joined to the forward end surface of the metallic shell 7 by laser welding or the like (ground electrode joining step).

Meanwhile, the center electrode 4 is inserted into the axial hole 2 of the insulator 3, and the flange portion 17 of the center electrode 4 is brought into engagement with the step portion 13 of the axial hole 2, whereby the center electrode 4 is disposed in the small-diameter portion 12 (first step).

Subsequently, a seal powder 15 which forms the first seal layer 23, a resistor composition 28 which forms the resistor 26, and a seal powder 16 which forms the second seal layer 24 are placed in this sequence into the axial hole 2 from the rear end thereof. Subsequently, a press pin 32 is inserted into the axial hole 2 so as to preliminarily compress them under a pressure of 60 $N/mm^2$ or greater. Thus, the seal powders 15, 16 and the resistor composition 28 are charged into the intermediate-diameter portion 14 (second step).

Subsequently, the forward end portion 20 of the metallic terminal 5 is inserted into the axial hole 2 from the rear end thereof, and the metallic terminal 5 is disposed such that the forward end portion 20 comes into contact with the seal powder 16 (third step).

Subsequently, a connection portion forming powder 27 is heated at a temperature equal to or higher than the glass softening point of the glass powder contained in the seal powders 15 and 16 (e.g., 800° C. to 1000° C.) for 3 min to 30 min. In this heated state, the metallic terminal 5 is pressed and inserted until the forward end surface of the exposed portion 18 of the metallic terminal 5 butts against the rear end surface of the insulator 3, whereby a load is applied to the connecting portion forming powder 27 (fourth step).

Thus, the seal powders 15, 16 and the resistor composition 28, which constitute the connecting portion forming powder 27, are sintered, whereby the first seal layer 23, the second seal layer 24, and the resistor 26 are formed. Also, the seal member which constitutes the first seal layer 23 and the second seal layer 24 is charged into the gap between the flange portion 17 and the wall surface of the axial hole 2 and between the forward end portion 20 and the wall surface of the axial hole 2. Thus, the center electrode 4 and the metallic terminal 5 are fixedly disposed in the axial hole 2 in a sealed condition. The above-described sectional images $S_n$ are captured up to the rearmost end position at which the seal member is present.

Next, the insulator 3 including the center electrode 4, the metallic terminal 5, etc., fixed thereto is assembled to the metallic shell 7 having the ground electrode 8 joined thereto (assembly step).

Finally, a distal end portion of the ground electrode 8 is bent toward the center electrode 4 such that the distal end of the ground electrode 8 faces the forward end portion of the center electrode 4. Thus, the spark plug 1 is completed.

The spark plug of the present invention can be obtained by performing the above-described manufacturing method, while adjusting the composition of the material which constitutes the metallic terminal 5, adjusting the length and diameter of the accommodated portion 19, adjusting an exposure length (K), which is the axial length from the forward end of the exposed portion 18 to the rear end surface of the insulator 3 in the third step, changing the hardness (deformability) of the seal powder and/or the resistor composition, and changing the temperature of hot press in the fourth step.

Figure 7:
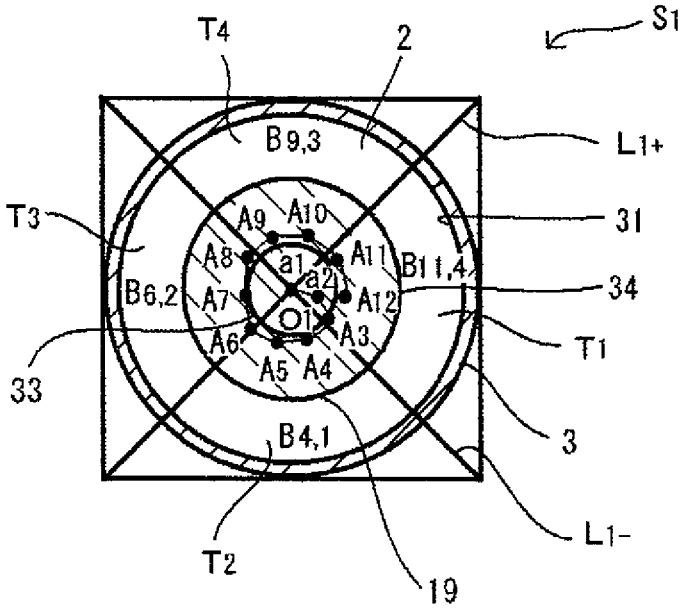
FIG. 7 is an explanatory top view of a spark plug which is another embodiment of the spark plug of the present invention with the sectional images $S_n$ thereof being superimposed.
Figure 8:
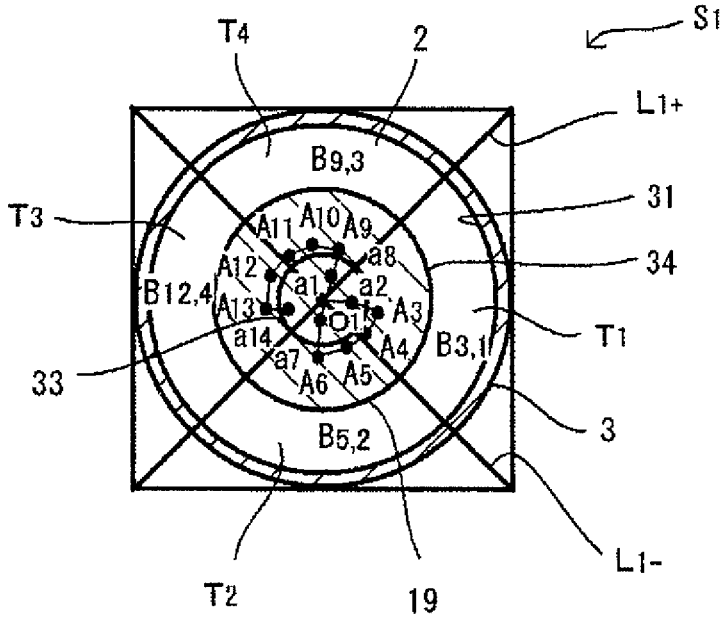
FIG. 8 is an explanatory top view of a spark plug which is still another embodiment of the spark plug of the present invention with the sectional images $S_n$ thereof being superimposed.
Figure 9:
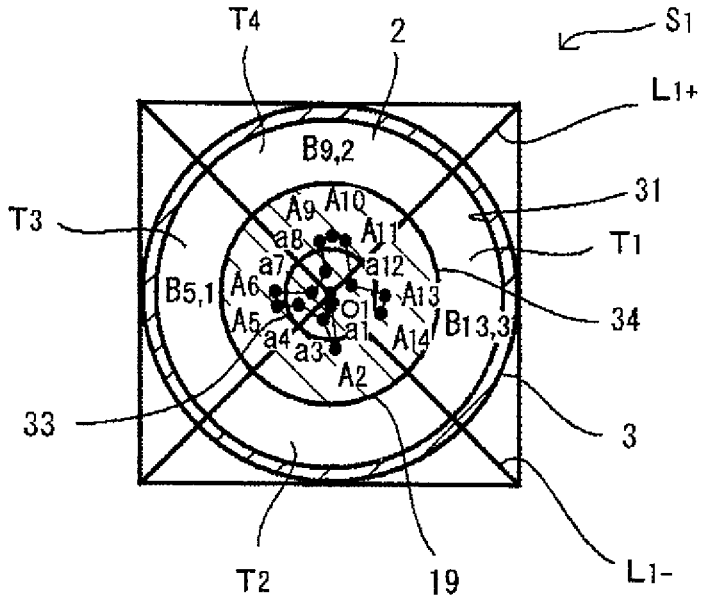
FIG. 9 is an explanatory top view of a spark plug which is still another embodiment of the spark plug of the present invention with the sectional images $S_n$ thereof being superimposed.

Spark plugs according to other embodiments of the spark plug of the present invention will be described with reference to FIGS. 7 to 9. Each of FIGS. 7 to 9 is an explanatory top view in which all the sectional images $S_n$ are superimposed such that the sectional image $S_1$ is located at the top. In order to facilitate the description, the accommodated portion 19 and the metallic shell 7 on the sectional images located below the sectional image $S_1$ are not illustrated, and only the center point $a_n$ or $A_n$ of the accommodated portion 19 is illustrated. In the discussion below, the position of the accommodated portion 19 in relation to the inner circumferential surface 31 of the axial hole 2 will be described. Also, in FIGS. 7 to 9, a circle which is centered at the axis O and which has the smallest radius is an imaginary line 33 which shows the position where the center point $a_n$ of the accommodated portion 19 satisfies a relational expression $H_{aon}=0.8(R_n-r_n)$ (which represents the case where the left and right sides of the relational expression (1) are equal to each other). When the center point $a_n$ is located on the outer side of the imaginary line 33, the center point $a_n$ satisfies the above-mentioned relational expression (1), and when the center point $a_n$ is located on the inner side of the imaginary line 33, the center point $a_n$ does not satisfy the above-mentioned relational expression (1). In other words, in the case where the distance between the axis O and the center point $a_n$ of the accommodated portion 19 deviated therefrom is at least 80% of $(R_n-r_n)$, the center point $a_n$ is located on the outer side of the circle (or on the imaginary line 33). Meanwhile, in the case where the distance between the axis O and the center point $a_n$ of the accommodated portion 19 deviated therefrom is less than 80% of $(R_n-r_n)$, the center point $a_n$ is located on the inner side of the imaginary line 33. Notably, as described above, when the center point $a_n$ is located on the outer side of the circle or located on the imaginary line 33, the enter point $a_n$ is defined as the point $A_n$.

As shown in FIG. 7, a locus which connects the points $a_n$ on the sectional images $S_n$ in the ascending order of the value of n has a spiral shape as viewed in plan. Since the sectional images $S_n$ are captured at intervals of 0.5 mm, in the spark plug of this embodiment, the accommodated portion 19 bends spirally. In the spark plug of this embodiment, the point $a_n$ satisfies the above-mentioned relational expression (1) when the point $a_n$ of the accommodated portion 19 is located on the outer side of the circle or located on the imaginary line 33, and the points $A_3$ to $A_{12}$ satisfy the above-mentioned relational expression (1).

As described, when the successive points $A_m$ to $A_{(m+k)}$ are present in a specific single area selected from the areas $T_1$ to $T_4$, the group including these points is defined as a group $B_{m,y}$. Therefore, the points $A_4$ and $A_5$ form a group $B_{4,1}$; the points $A_6$ to $A_8$ form a group $B_{6,2}$, the points $A_9$ and $A_{10}$ form a group $B_{9,3}$; and the points $A_{11}$ and $A_{12}$ form a group $B_{11,4}$. The group $B_{4,1}$ is present in the area $T_2$; the group $B_{6,2}$ is present in the area $T_3$; the group $B_{9,3}$ is present in the area $T_4$; and the group $B_{11,4}$ is present in the area $T_1$.

Accordingly, in the spark plug of the present embodiment, since the number of the groups $B_{m,y}$ is four, the maximum value of y is four, and these groups $B_{m,y}$ are present in all the areas $T_1$ to $T_4$.

As shown in FIG. 8, a locus which connects the points $a_n$ on the sectional images $S_n$ in the ascending order of the value of n has an 8-like shape as viewed in plan. Since the sectional images $S_n$ are captured at intervals of 0.5 mm, in the spark plug of this embodiment, the accommodated portion 19 bends such that the accommodated portion 19 approaches a certain portion of the inner circumferential surface of the insulator, returns to the vicinity of the axis, and bends such that the accommodated portion 19 approaches another portion of the inner circumferential surface, which portion is located opposite the certain portion. In the spark plug of this embodiment, the point $a_n$ satisfies the above-mentioned relational expression (1) when the point $a_n$ of the accommodated portion 19 is located on the outer side of the circle or located on the imaginary line 33, and the points $A_3$ to $A_6$ and the points $A_9$ to $A_{13}$ satisfy the above-mentioned relational expression (1).

As described, when the successive points $A_m$ to $A_{(m+k)}$ are present in a specific single area selected from the areas $T_1$ to $T_4$, the group including these points is defined as a group $B_{m,y}$. Therefore, the points $A_3$ and $A_4$ form a group $B_{3,1}$; the points $A_5$ and $A_6$ form a group $B_{5,2}$, the points $A_9$ to $A_{11}$ form a group $B_{9,3}$; and the points $A_{12}$ and $A_{13}$ form a group $B_{12,4}$. The group $B_{3,1}$ is present in the area $T_1$; the group $B_{5,2}$ is present in the area $T_2$; the group $B_{9,3}$ is present in the area $T_4$; and the group $B_{12,4}$ is present in the area $T_3$.

Accordingly, in the spark plug of the present embodiment, since the number of the groups $B_{m,y}$ is four, the maximum value of y is four, and these groups $B_{m,y}$ are present in all the areas $T_1$ to $T_4$.

As shown in FIG. 9, a locus which connects the points $a_n$ on the sectional images $S_n$ in the ascending order of the value of n has a star-like shape as viewed in plan. Since the sectional images $S_n$ are captured at intervals of 0.5 mm, in the spark plug of this embodiment, the accommodated portion 19 bends to the vicinity of the inner circumferential surface of the insulator, returns to the vicinity of the axis, and repeats this bending pattern of bending to the vicinity of the inner circumferential surface of the insulator and returning to the vicinity of the axis. In the spark plug of this embodiment, the point $a_n$ satisfies the above-mentioned relational expression (1) when the point $a_n$ of the accommodated portion 19 is located on the outer side of the circle or located on the imaginary line 33, and the points $A_2$, $A_5$, $A_6$, $A_9$ to $A_{11}$, $A_{13}$, and $A_{14}$ satisfy the above-mentioned relational expression (1).

As described, when the successive points $A_m$ to $A_{(m+k)}$ are present in a specific single area selected from the areas $T_1$ to $T_4$, the group including these points is defined as a group $B_{m,y}$. Therefore, the points $A_5$ and $A_6$ form a group $B_{5,1}$, the points $A_9$ to $A_{11}$ form a group $B_{9,2}$; and the points $A_{13}$ and $A_{14}$ form a group $B_{13,3}$. The group $B_{5,1}$ is present in the area $T_3$; the group $B_{9,2}$ is present in the area $T_4$; and the group $B_{13,3}$ is present in the area $T_1$.

Accordingly, in the spark plug of the present embodiment, since the number of the groups $B_{m,y}$ is three, the maximum value of y is three, and these groups $B_{m,y}$ are present in three areas $T_1$, $T_3$, and $T_4$.

The spark plug according to the present invention is used as an ignition plug for an internal combustion engine (e.g., a gasoline engine) for automobiles. The above-mentioned threaded portion 9 is screwed into a threaded hole provided in a head (not shown) which defines and forms combustion chambers of the internal combustion engine, whereby the spark plug is fixed at a predetermined position. Although the spark plug according to the present invention can be used for any internal combustion engine, the spark plug is favorably used for an internal combustion engine in which the space for spark plugs is required to reduce, because the present invention provides a remarkable effect when it is applied to spark plugs having a reduced diameter.

The spark plug of the present invention is not limited to the above-described embodiment, and various modifications are possible within a range in which the object of the present invention can be achieved. For example, in the case of the spark plug 1, the knurled fixing portion 25 is provided at the forward end of the metallic terminal 5. However, no particular limitation is imposed on the method of processing the surface of the fixing portion 25 so long as the surface of the fixing portion 25 has a shape (e.g., an uneven shape) which enhances the adhesion between the fixing portion 25 and the seal member. For example, the surface of the fixing portion 25 may have a shape formed by threading or the like. Also, each of the entire outer circumferential surface and the entire forward end surface of the accommodated portion may have an uneven shape, and the entire surface of the accommodated portion may form the fixing portion. Alternatively, a portion of the surface of the accommodated portion may have an uneven shape.

Example 1

Manufacture of Spark Plug

The spark plug shown in FIG. 1 was manufactured in accordance with the above-described manufacturing process. Notably, there were manufactured spark plugs which were made different from one another in the number of groups $B_{m,y}$ and the areas including the groups $B_{m,y}$ by changing the axial length of the accommodated portion (accommodated portion length), the diameter of the axial hole of the insulator at the center-electrode-side forward end of the metallic terminal (the intermediate-diameter portion diameter), and the length (exposure length (K)) (along the direction of the axis O) from the forward end of the exposed portion to the rear end of the insulator in the third step.

Through use of a micro X-ray CT apparatus (e.g., TOSCANER-32250μhd), the sectional images $S_n$ of each spark plug were captured at intervals of 0.5 mm from the rear end of the accommodated portion toward the forward end thereof up to the rear end position where the connection member is present, and the number of groups $B_{m,y}$ and the areas ($T_1$ to $T_4$) including the groups $B_{m,y}$, and the inter-bend distance D were investigated on the basis of the sectional images $S_n$.

Evaluation Method (Load Life Performance Test)

Each of the manufactured spark plugs was placed in an environment of 350° C., and a discharge voltage of 20 kV was applied thereto so as to generate discharge 3600 times over 1 min. The resistance $R_0$ of the resistor of each spark plug before this test and the resistance $R_1$ of the resistor after this test were measured. This test was carried out 10 times, and the time at which the ratio ($R_1/R_0$) of the average of the resistances $R_1$ after the test to the initial resistance $R_0$ became 1.5 or greater was measured. In consideration of the fact that the longer the above-mentioned time, the better the load life performance, the manufactured spark plugs were evaluated in accordance with the following criteria. The results of the evaluation are shown in Table 1 set forth below.

x: shorter than 150 hours

○: 150 hours or longer (Load Life Performance Test after Impact Resistance Test)

In accordance with JIS B 8031, an impact resistance test was performed for the manufactured spark plugs.

The spark plugs after having undergone the impact resistance test were tested in the same manner as in the above-described load life performance test, and were evaluated in accordance the following criteria. The results of the evaluation are shown in Table 1 set forth below.

1: shorter than 5 minutes 1.5: not shorter than 5 minutes but shorter than 20 hours 2: not shorter than 20 hours but shorter than 150 hours 2.5: not shorter than 150 hours but shorter than 180 hours 3 to 8.5: after 180 hours, 0.5 point was added every 20 hours 9: not shorter than 420 hours but shorter than 450 hours 9.5: not shorter than 450 hours but shorter than 500 hours 10: 500 hours or longer

TABLE 1

| No. | | Diameter of intermediate-diameter portion (mm) | Length of accommodated portion (mm) | Exposure length K (mm) | Number of groups $B_{m,y}$ | Inter-bend distance D (mm) | Number of areas containing groups Bm, y (max: 4) | Presence/ absence of symmetry of areas containing Bm, y | Results of load life performance test | Results of load life performance test after impact resistance test |
|---|---|---|---|---|---|---|---|---|---|---|
| 1 | Example | 2.7 | 33 | 13 | 8 | 10 | 4 | ○ | ○ | 10 |
| 2 | | 2.7 | 33 | 15 | 12 | 10 | 4 | ○ | ○ | 10 |

TABLE 1-continued

| No. | | Diameter of intermediate-diameter portion (mm) | Length of accommodated portion (mm) | Exposure length K (mm) | Number of groups $B_{m,y}$ | Inter-bend distance D (mm) | Number of areas containing groups Bm, y (max: 4) | Presence/ absence of symmetry of areas containing Bm, y | Results of load life performance test | Results of load life performance test after impact resistance test |
|---|---|---|---|---|---|---|---|---|---|---|
| 3 | Comparative | 2.7 | 33 | 9.5 | 1 | — | 1 | X | ○ | 1 |
| 4 | Example | 2.7 | 33 | 10 | 2 | 5 | 1 | X | ○ | 1 |
| 5 | | 2.7 | 33 | 10.5 | 3 | 5 | 2 | X | ○ | 1 |
| 6 | Example | 2.7 | 33 | 10.5 | 3 | 4 | 2 | ○ | ○ | 2.5 |
| 7 | | 2.7 | 33 | 10.7 | 3 | 5 | 2 | ○ | ○ | 3 |
| 8 | | 2.7 | 33 | 10.7 | 3 | 6 | 2 | ○ | ○ | 4 |
| 9 | | 2.7 | 33 | 10.6 | 4 | 6 | 3 | ○ | ○ | 4.5 |
| 10 | | 2.7 | 33 | 11 | 4 | 7 | 3 | ○ | ○ | 5 |
| 11 | | 2.7 | 33 | 10.8 | 5 | 7 | 3 | ○ | ○ | 5.5 |
| 12 | | 2.7 | 33 | 11.2 | 5 | 7 | 4 | ○ | ○ | 6 |
| 13 | | 2.7 | 33 | 11.5 | 6 | 7 | 4 | ○ | ○ | 6.5 |
| 14 | | 2.7 | 33 | 11.7 | 6 | 8 | 4 | ○ | ○ | 7 |
| 15 | | 2.9 | 33 | 10.7 | 5 | 7 | 4 | ○ | ○ | 6 |
| 16 | | 2.9 | 33 | 10.8 | 6 | 8 | 4 | ○ | ○ | 7 |
| 17 | Comparative Example | 3.5 | 33 | 10.5 | 3 | 5 | 2 | X | ○ | 1.5 |
| 18 | Example | 3.5 | 33 | 10.5 | 3 | 5 | 2 | ○ | ○ | 3.5 |
| 19 | | 2.7 | 37 | 12.7 | 8 | 30 | 4 | ○ | ○ | 10 |
| 20 | | 2.7 | 45 | 12.7 | 10 | 37 | 4 | ○ | ○ | 10 |
| 21 | | 2.7 | 37 | 11.3 | 6 | 8 | 4 | ○ | ○ | 6.5 |
| 22 | | 2.7 | 37 | 11.7 | 6 | 10 | 4 | ○ | ○ | 10 |
| 23 | | 2.7 | 45 | 10.9 | 6 | 8 | 4 | ○ | ○ | 6.5 |
| 24 | | 2.7 | 45 | 11.3 | 6 | 10 | 4 | ○ | ○ | 10 |
| 25 | | 2.5 | 38 | 11.2 | 7 | 6 | 3 | ○ | ○ | 4.5 |
| 26 | | 2.5 | 38 | 11.5 | 7 | 8 | 4 | ○ | ○ | 7 |
| 27 | | 2.5 | 38 | 11.8 | 10 | 10 | 4 | ○ | ○ | 10 |
| 28 | | 2.1 | 38 | 11.4 | 7 | 6 | 3 | ○ | ○ | 4.5 |
| 29 | | 2.1 | 38 | 11.5 | 7 | 8 | 4 | ○ | ○ | 7 |
| 30 | | 2.1 | 38 | 11.7 | 10 | 10 | 4 | ○ | ○ | 10 |
| 31 | | 2.9 | 33 | 10.5 | 3 | 5 | 2 | X | ○ | 1 |
| 32 | | 2.9 | 33 | 10.7 | 3 | 5 | 2 | ○ | ○ | 3 |

As shown in Table 1, the spark plugs falling inside the range of the invention were excellent in the results of the load life performance test and the results of the load life performance test performed after the impact resistance test. In contrast, the spark plugs falling outside the range of the invention were poor in the results of the load life performance test performed after the impact resistance test although they were excellent in results of the load life performance test.

| DESCRIPTION OF REFERENCE NUMERALS | |
|---|---|
| 1: | spark plug |
| 2: | axial hole |
| 3: | insulator |
| 4: | center electrode |
| 5: | metallic terminal |
| 6: | seal portion |
| 7: | metallic shell |
| 8: | ground electrode |
| 9: | threaded portion |
| 10: | talc |
| 11: | packing |
| 12: | smaller-diameter portion |
| 13: | step portion |
| 14: | intermediate-diameter portion |
| 15, 16: | seal powder |
| 17: | flange portion |
| 18: | exposed portion |
| 19: | accommodated portion |
| 20: | forward end portion |
| 22: | trunk portion |
| 23: | first seal layer |
| 24: | second seal layer |
| 25: | fixing portion |

-continued

| DESCRIPTION OF REFERENCE NUMERALS | |
|---|---|
| 26: | resistor |
| 27: | connecting portion forming powder |
| 28: | resistor composition |
| 29, 30: | noble metal tip |
| 31: | inner circumferential surface |
| 32: | press pin |
| 33: | imaginary line |
| 34: | outer circumferential surface |

Having described the invention, the following is claimed:

1. A spark plug comprising:

an insulator having an axial hole extending in a direction of an axis;

a center electrode held at one end of the axial hole;

a metallic terminal which has an accommodated portion accommodated in the axial hole and which is held at the other end of the insulator; and a connecting portion which electrically connects the center electrode and the metallic terminal within the axial hole, wherein:

the side of the axial hole where the metallic terminal is held is defined as a rear end side with respect to the direction of the axis;

a connection member which constitutes the connecting portion is provided between an outer circumferential surface of a forward end portion of the accommodated portion and an inner circumferential surface of the insulator; and in sectional images orthogonal to the axis which are captured at intervals of 0.5 mm from a rear end of the accommodated portion toward a forward end thereof up to a rear end position where the connection member is present, on a sectional image $S_n$ at the n-th section, n being a natural number, counted from the rear end of the accommodated portion, a center of the accommodated portion is defined as a point $a_n$, a center of the axial hole is defined as a point $O_n$, a line which passes through the points $a_n$ and $O_n$ is defined as a line $L_n$, a diameter of the axial hole is represented by $2R_n$, a diameter of the accommodated portion is represented by $2r_n$, a distance between the point $a_n$ and the point $O_n$ is represented by $H_{aon}$, and the point $a_n$ which satisfies a relation $H_{aon} \geq 0.8(R_n - r_n)$ is defined as a point $A_n$, on the sectional image $S_1$, a line which is obtained by rotating a line $L_1$ by 45° about the point $O_1$ is defined as a line $L_{1+}$, a line which is obtained by rotating the line $L_1$ by −95° about the point $O_1$ is defined as a line $L_{1-}$, four areas which are surrounded by a plane $X_+$ containing the line $L_{1+}$ and the axis, a plane $X_-$ containing the line $L_{1-}$ and the axis, and the inner circumferential surface of the insulator are areas $T_1$, $T_2$, $T_3$, and $T_4$, respectively, and when successive points $A_m$ to $A_{(m+k)}$, m and k being natural numbers, are present in a specific area selected from the areas $T_1$, $T_2$, $T_3$, and $T_4$, a group containing these points $A_m$ to $A_{(m+k)}$ is defined as a group $B_{m,y}$, where y is a natural number and means that the group is the y-th group counted from the rear end side of the accommodated portion, wherein the maximum value of y is at least 3, and at least two of the groups $B_{m,y}$ are present in two areas which are selected from the areas $T_1$ to $T_4$ and which are located at symmetrical positions.

2. A spark plug according to claim 1, wherein an inter-bend distance D, which is a distance along the direction of the axis between a sectional image containing a point $A_s$, which is the first point $A_n$ counted from the rear end of the accommodated portion, and a sectional image containing a point $A_e$, which is the last point $A_n$ counted from the rear end of the accommodated portion, is 5 mm or greater.

3. A spark plug according to claim 1 wherein the groups $B_{m,y}$ are present in at least three areas selected from the areas $T_1$ to $T_4$.

4. A spark plug according to claim 1, wherein the maximum value of y is at least 4.

5. A spark plug according to claim 1, wherein the groups $B_{m,y}$ are present in all the areas $T_1$ to $T_4$.

6. A spark plug according to claim 1, wherein the maximum value of y is at least 5.

7. A spark plug according to claim 1, wherein an intermediate-diameter portion diameter, which is a diameter of the axial hole at a position where the forward end portion is disposed, is 2.9 mm or less.

8. A spark plug according to claim 1, wherein the inter-bend distance D is 7 mm or greater.

9. A spark plug according to claim 1, wherein the inter-bend distance D is 10 mm or greater.

* * * * *